US011555389B2

(12) United States Patent
Garrett et al.

(10) Patent No.: US 11,555,389 B2
(45) Date of Patent: Jan. 17, 2023

(54) METHOD AND SYSTEM OF PRODUCING HYDROCARBONS USING DATA-DRIVEN INFERRED PRODUCTION

(71) Applicant: ExxonMobil Upstream Research Company, Spring, TX (US)

(72) Inventors: Richard D. Garrett, Conroe, TX (US); Marco de Mattia, Houston, TX (US); Curtis J. Holub, Spring, TX (US); Neeraj R. Dani, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 17/365,004

(22) Filed: Jul. 1, 2021

(65) Prior Publication Data

US 2022/0034208 A1 Feb. 3, 2022

Related U.S. Application Data

(60) Provisional application No. 63/057,530, filed on Jul. 28, 2020.

(51) Int. Cl.
*E21B 43/12* (2006.01)
*E21B 47/10* (2012.01)

(52) U.S. Cl.
CPC ..... *E21B 43/128* (2013.01); *E21B 47/10* (2013.01); *E21B 2200/20* (2020.05)

(58) Field of Classification Search
CPC .... E21B 43/121; E21B 43/122; E21B 43/127; E21B 43/128
See application file for complete search history.

(56) References Cited

U.S. PATENT DOCUMENTS

| | | | | |
|---|---|---|---|---|
| 9,206,676 | B2 * | 12/2015 | Quigley | E21B 43/122 |
| 9,903,193 | B2 * | 2/2018 | Harding | F04B 17/03 |
| 10,370,945 | B2 * | 8/2019 | Boiko | G05B 13/041 |
| 10,428,629 | B2 * | 10/2019 | Liu | E21B 43/127 |
| 10,494,906 | B2 * | 12/2019 | Nandola | E21B 41/0092 |
| 10,900,481 | B2 * | 1/2021 | Singal | F04B 53/10 |
| 2012/0095733 | A1 * | 4/2012 | Rossi | E21B 43/00 703/2 |
| 2020/0157922 | A1 * | 5/2020 | Stout | E21B 47/009 |
| 2021/0181374 | A1 * | 6/2021 | Sandnes | G06F 30/18 |

* cited by examiner

*Primary Examiner* — Kenneth L Thompson
(74) *Attorney, Agent, or Firm* — ExxonMobil Upstream Research Company—Law Department

(57) ABSTRACT

A method of predicting hydrocarbon production from one or more artificial lift wells is disclosed. Test data is obtained from the artificial lift well. A decline curve model, representing well performance, is generated for one or more fluids in the artificial lift well. Measurement values are obtained from an artificial lift operation. For each of the obtained measurement values, a measurement model is generated that correlates the measurement values to the decline curve. A Kalman filter is used to predict production outputs of at least one of oil, gas, and water for the well, and to generate an uncertainty range for the predicted production outputs. The Kalman filter uses the decline curves to predict the production outputs, and uses the measurement models to correct and/or update the predicted production outputs. Hydrocarbon production activities are modified using the corrected and/or updated predicted production outputs.

19 Claims, 6 Drawing Sheets

METHOD AND SYSTEM OF PRODUCING HYDROCARBONS USING DATA-DRIVEN INFERRED PRODUCTION

CROSS-REFERENCE TO RELATED APPLICATIONS

This application claims the benefit of U.S. Provisional Patent Application No. 63/057,530, filed Jul. 28, 2020, the disclosure of which is hereby incorporated by reference in its entirety.

This application is related to U.S. patent application Ser. No. 16/436,402, the entirety of which is incorporated by reference herein.

FIELD OF THE INVENTION

The disclosure relates generally to hydrocarbon production. More specifically, the disclosure relates to determining production rates of hydrocarbon wells.

BACKGROUND OF THE INVENTION

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as admissions of prior art.

Artificial lift technology is being increasing applied to provide uplift in production wells in both conventional and unconventional assets. To measure production/uplift from a well (using artificial lift technology), well tests are periodically performed. These well tests, which are expensive to perform, provide production information only during the duration of the well test. The duration of a typical well test is a few hours, and for a given well, well tests are performed a few times per year. As a result, between two successive well tests (which may be separated by days or weeks or months), there is no information about the production. Knowing current production rates can be useful in planning for hydrocarbon production activities, but constantly performing well tests can be burdensome even in production fields with just a few producing/injecting wells. What is needed is an economical method of determining or inferring production rates of hydrocarbon wells.

SUMMARY OF THE INVENTION

The present disclosure provides a method of predicting hydrocarbon production from one or more artificial lift wells. Test data is obtained from the artificial lift well using a well test. Based on the obtained test data, a decline curve model is generated for one or more fluids in the artificial lift well. The decline curve represents well performance. Measurement values are obtained from an artificial lift operation. For each of the obtained measurement values, a measurement model is generated that correlates the measurement values to the decline curve. Using a Kalman filter, production outputs of at least one of oil, gas, and water for the well are predicted, and an uncertainty range for the predicted production outputs is generated. The Kalman filter uses the decline curves to predict the production outputs, and uses the measurement models to correct and/or update the predicted production outputs. Hydrocarbon production activities are modified using the corrected and/or updated predicted production outputs.

In another aspect, an apparatus for predicting production data from one or more artificial lift wells is disclosed. An input device is in communication with a processor and receives input data comprising measurement values from an artificial lift operation, and well test data from the one or more artificial lift wells representing well performance at more than one time period. A memory is in communication with the processor. The memory has a set of instructions that, when executed by the processor: generate a decline curve model based on the obtained test data for one or more two fluids in the artificial lift well, the decline curve representing well performance; for each of the obtained measurement values, generate a measurement model that correlates the measurement values to the decline curve; use a Kalman filter to predict production outputs of at least one of oil, gas, and water for the well, and generate an uncertainty range for the predicted production outputs, wherein the Kalman filter uses the decline curves to predict the production outputs; and uses the measurement models to correct and/or update the predicted production outputs. Corrected and/or updated predicted production outputs are provided so that hydrocarbon production activities may be modified.

The foregoing has broadly outlined the features of the present disclosure in order that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
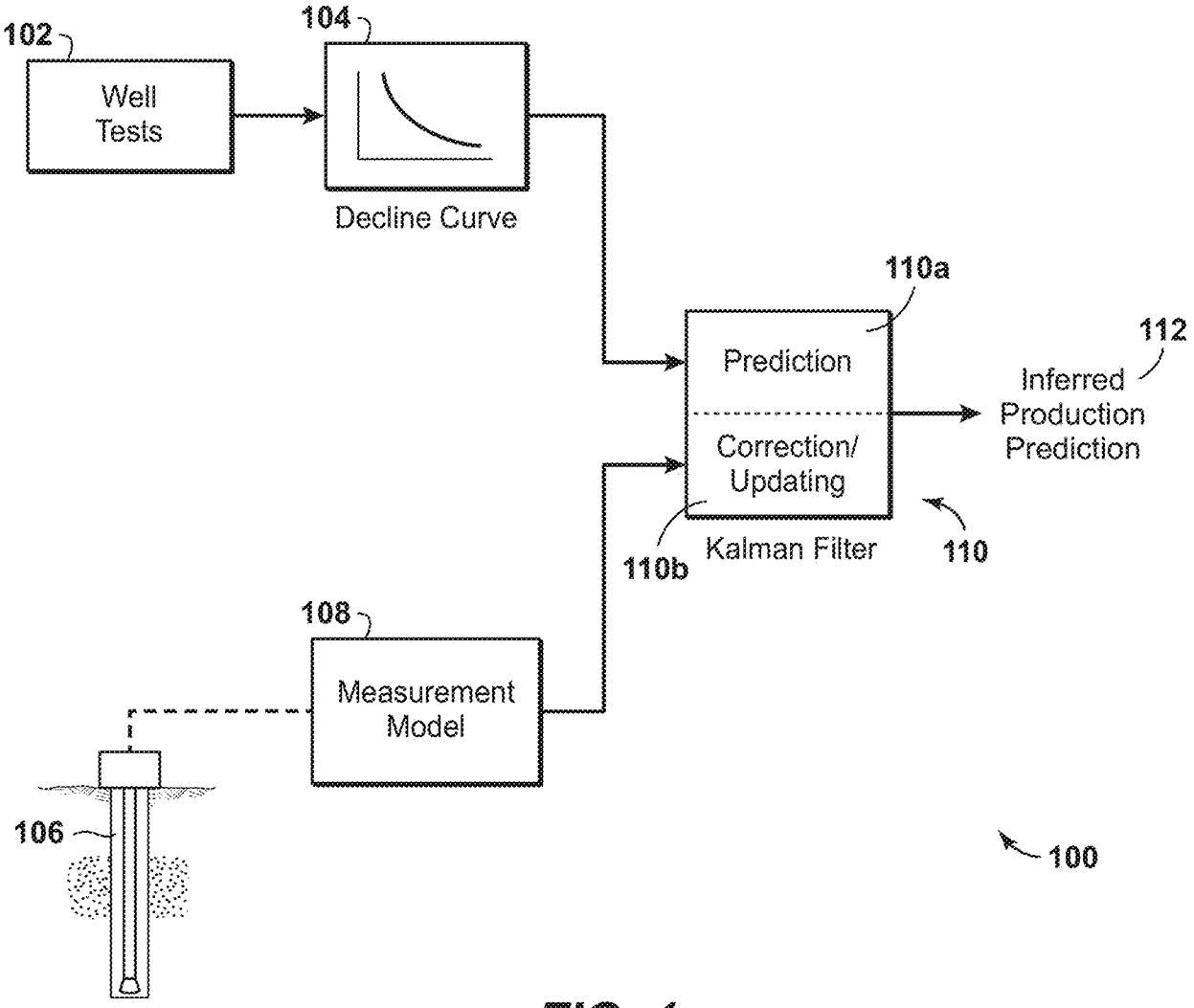
FIG. 1 is a schematic flowchart showing a method according to the disclosed aspects.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION OF THE INVENTION

For the purpose of promoting an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. It will be apparent to those skilled in the relevant art that some features that are not relevant to the present disclosure may not be shown in the drawings for the sake of clarity.

Aspects of the disclosure predict real-time production for one or more interconnected or commingled wells using artificial lift technology. The prediction is based on individual well characteristics. Further, disclosed aspects focus on artificial lift technologies, such as electric submersible pumps (ESPs), progressing cavity pumps (PCPs), rod pumps, gas lift pumps, or other similar technologies. Aspects of the disclosure are based on measured performance data of the artificial lift technology with historical well test data. Well-by-well real-time predictions derived therefrom are useful in the context for well and/or field surveillance and optimization. The disclosed aspects may also applied to one or more interconnected or commingled wells that use multistage pumps.

The following provides a detailed description of the approach developed according to disclosed aspects. The example described below uses ESPs as the artificial lift technology. However, an analogous approach is applicable when PCPs, rod pumps, or other artificial lift technologies are used.

The disclosed aspects provide a method of producing hydrocarbon production estimates. Two data-driven models form part of this method: decline curves and measurement models. These two data-driven models are combined with real-time measurement data using an extended Kalman filter to generate predictions of hydrocarbon well production. The disclosed aspects will be explained using the method 100 shown in the schematic flowchart of FIG. 1.

Well production is expected to decay exponentially over time. This decay can be decreasing or increasing. FIGS. 2A-2C show production data obtained during well tests taken over an 18-month period for a single well. FIGS. 2A-2C show flow rate declines for oil 202, water 204, and gas 206, respectively. According to an aspect, this well test production data, shown generically in FIG. 1 at 102, is fit to an increasing or decreasing exponential decay model. Whichever model better fits the data is used. Any combination of time-based well production data (i.e., oil, water, and gas production) may be fit to one or more curves, such as: total liquid production (water production plus oil production), water cut (water production/total liquid production), and/or gas/oil ratio (gas production/oil production). A general increasing exponential decay model or function may be written as:

$$q_i = A(1 - Be^{-Ct})$$

and a general decreasing exponential decay model or function may be written as:

$$q_i = Ae^{-Bt}$$

where q is the production flow rate; i is the production type, which may be oil, water, gas, or a combination thereof; A, B, and C are constants greater than zero determined via regression analysis to the well test production data; and t is time. The regression analysis may employ a least-squares approximation or other known approximation techniques.

For each well, the selected exponential decay models/functions are used to generate decline curves 104 for the desired production quantities. For example, if oil, water, and gas production are to be predicted, three decline curves are generated from the from the well test data and are stored. As new well tests are performed, the decline curves are regenerated to incorporate the most recent information available.

Figure 2A:
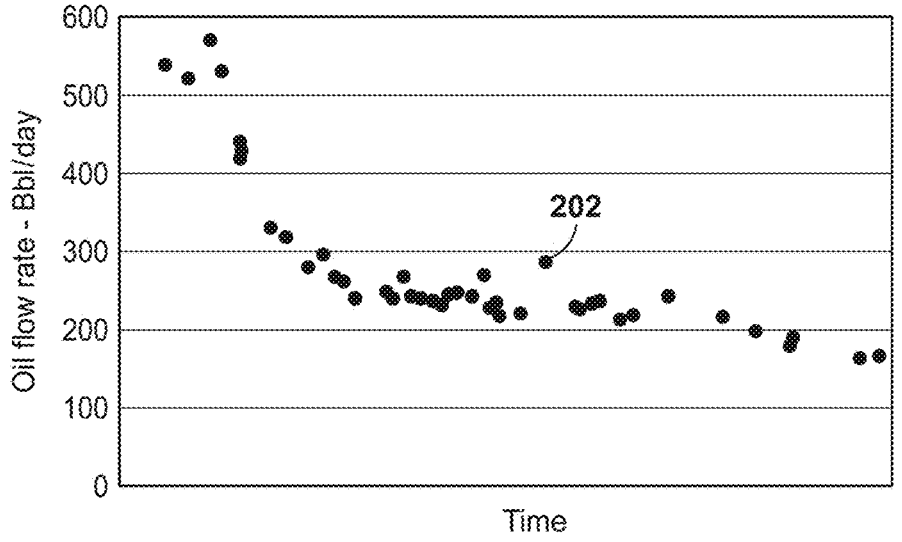
FIGS. 2A-2C are graphs showing oil, water, and gas production data from well tests.
Figure 2B:
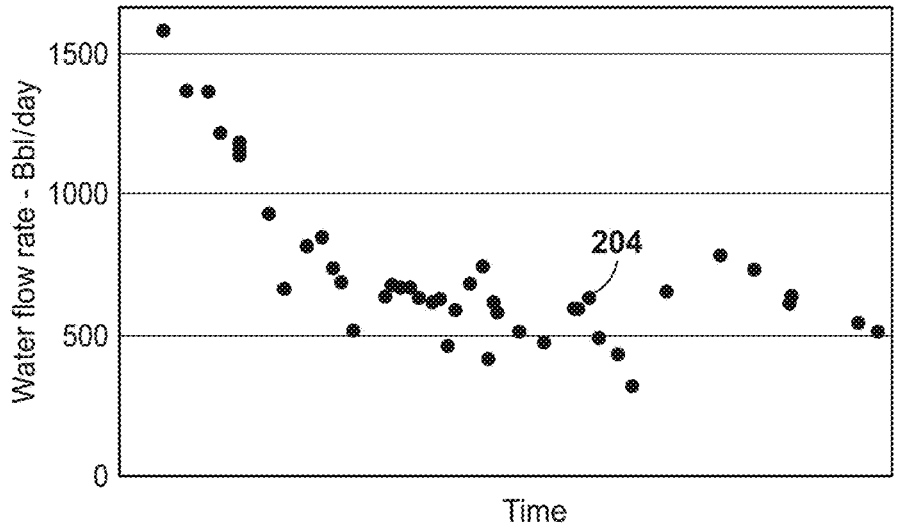
Figure 2C:
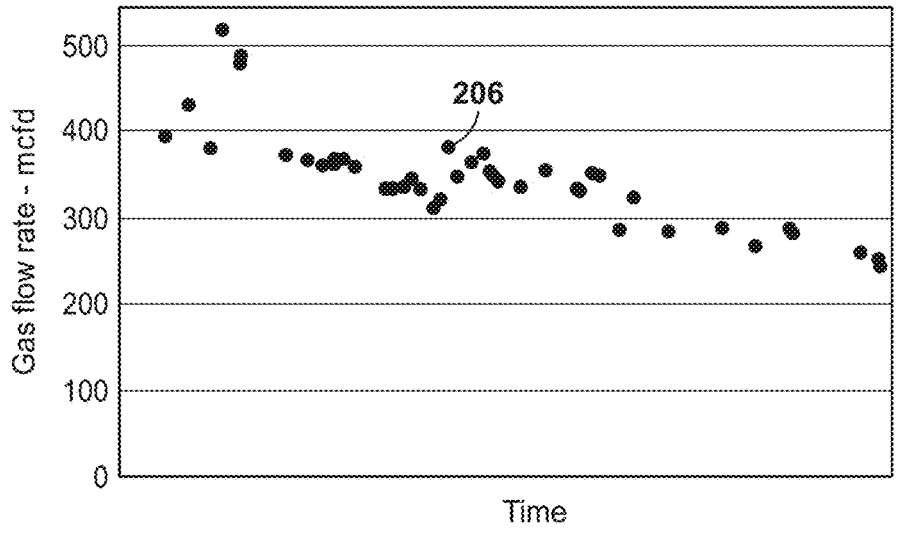

While production data is only available during well tests, electric submersible pumps, shown in FIG. 1 at 106, typically have other measurements available in real-time. These may include drive frequency, motor current, motor temperature, pump intake pressure, and pump intake temperature. To combine these measurements with the decline curves, a relationship between the production values and these measurements must be found. A linear relationship between the production values and measurements is used in this method. Historical well test production values and measurement values at the well test are used to generate a measurement model 108 for each measurement. If oil, water, and gas production predictions are desired, each measurement model will have the form of:

$$z_j = A_{jo}q_o + A_{jw}q_w + A_{jg}q_g + D$$

where z is the measurement; j denotes which measurement (drive frequency, motor current, pump intake pressure, etc.); $A_{jo}$, $A_{jw}$, and $A_{jg}$ are constants determined by least squares (or another suitable regression strategy) to historical measurement and well test production data; $q_o$, $q_w$, and $q_g$ are production flow rates for oil, water, and gas, respectively, and D is a constant determined via regression analysis to the well test production data.

For each well, measurement models are generated and stored for each real-time measurement used. As new well tests are performed, these measurement models must be regenerated to incorporate the most recent information available.

An extended Kalman filter 110 is used to combine the decline curves and measurement models into production predictions. A Kalman filter has the benefit of providing predictions and uncertainty ranges (e.g., error bars) for each desired production value and can be made robust to data disruptions. Kalman filters produce predictions and uncertainty ranges through a process of two steps: a prediction step and a correction/updating step. In the disclosed method, the prediction step 110*a* of the Kalman filter involves the decline curves, while the correction/updating step 110*b* involves the use of the measurement models. Instead of a Kalman filter, other linear quadratic estimation algorithms may be used.

In the prediction step 110*a*, the production values and corresponding uncertainties are predicted as a function of time from the decline curves 104 (e.g., oil, water, and gas) generated from the historical well test data 102.

In the correction/updating step 110*b*, the production predictions from the prediction step 110*a* are used to predict the current measurement values from the electric submersible pump 106 (e.g., drive frequency, motor current, motor temperature, pump intake pressure, pump intake temperature). These predicted measurement values 112 are compared to the actual measurement values. This comparison is used within the Kalman filter to correct the production value predictions and the corresponding uncertainties.

Figure 3A:
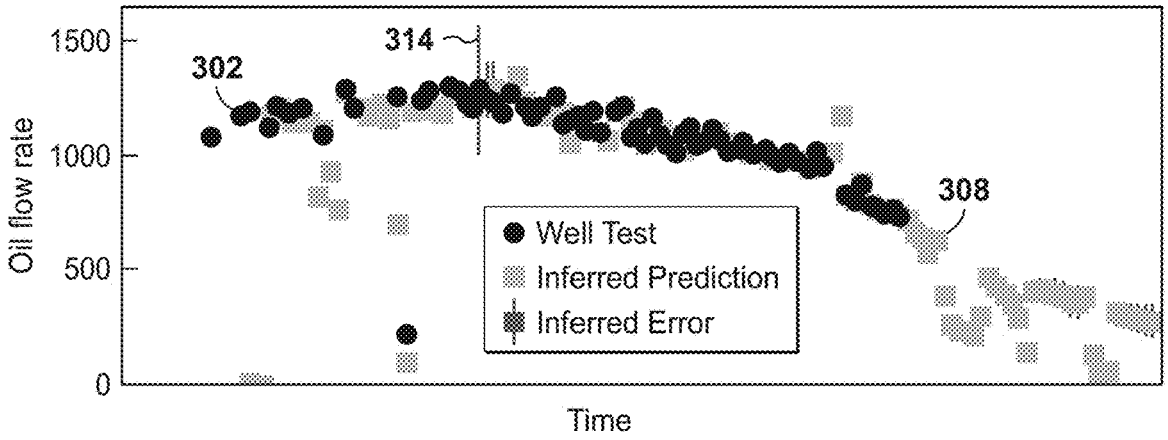
FIGS. 3A-3C are graphs comparing well test data with inferred predictions for oil, water and gas flow rates using methods according to disclosed aspects.
Figure 3B:
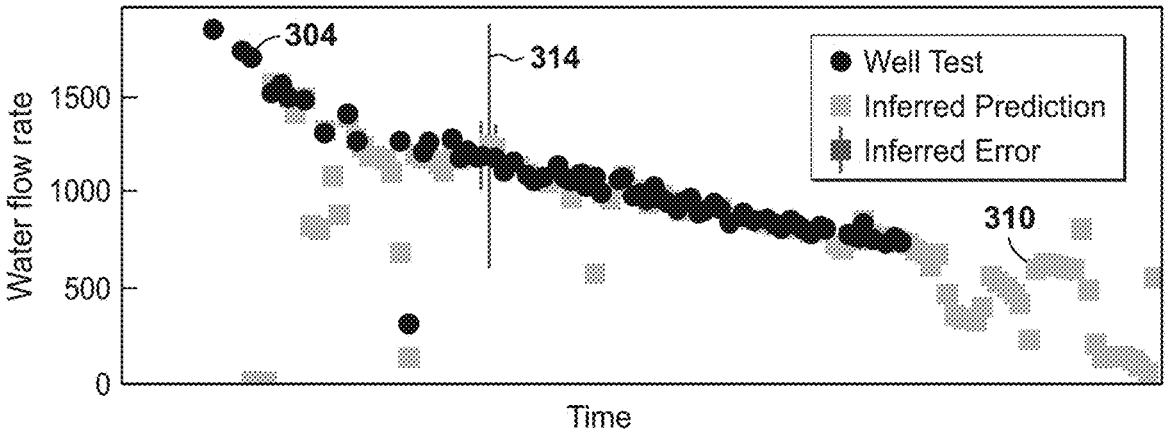
Figure 3C:
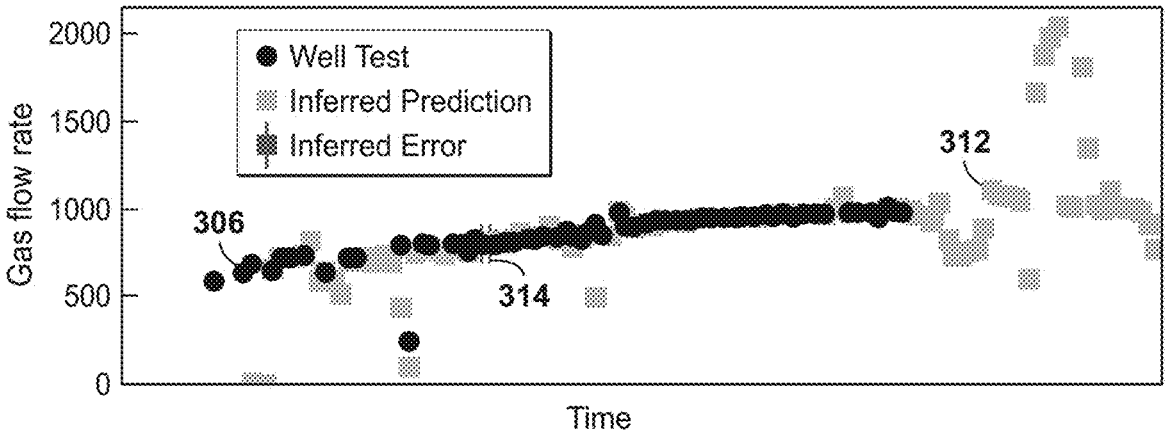
Figure 4A:
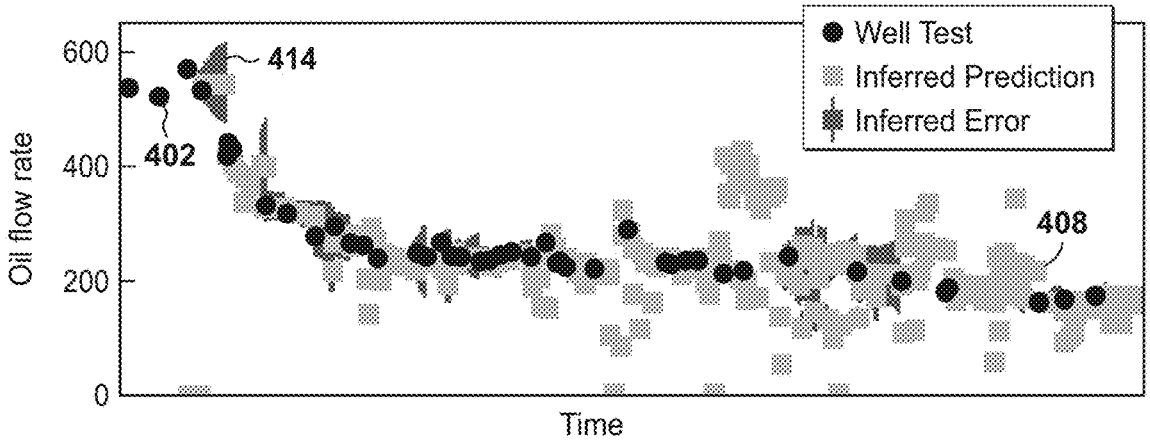
FIG. 4A-4C are graphs comparing well test data with inferred predictions for oil, water and gas flow rates using methods according to disclosed aspects.
Figure 4B:
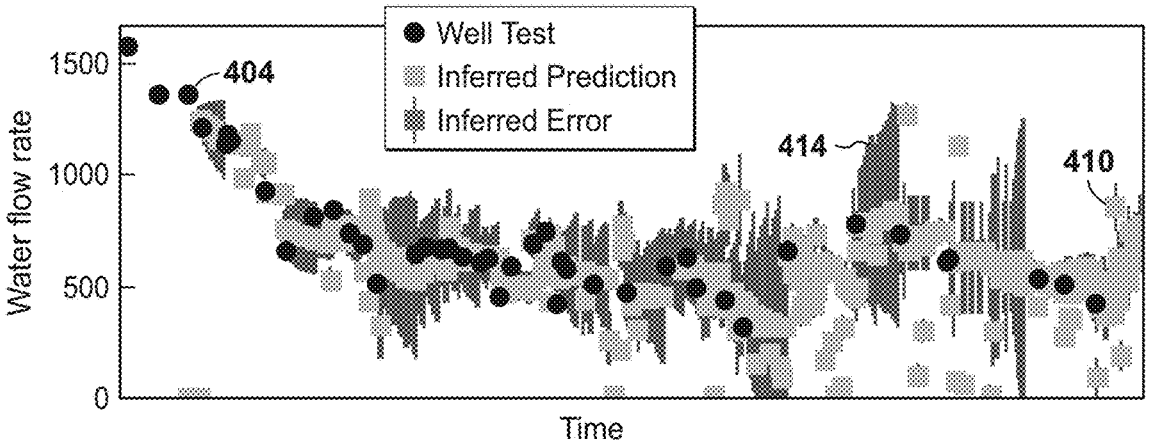
Figure 4C:
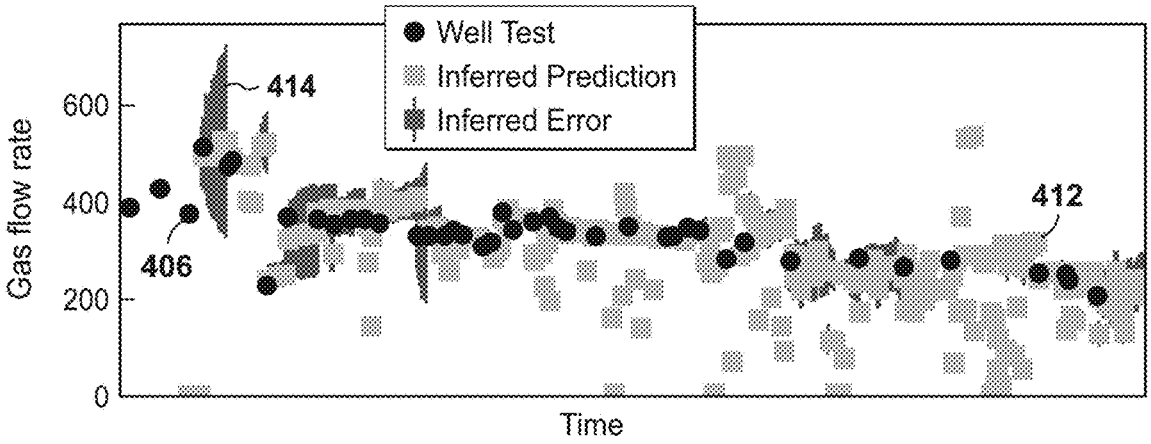

FIGS. 3A-3C and 4A-4C show the use of the disclosed method with two different wells. In each figure, the circles are historical well test production values for oil flow rates 302, 402 (FIGS. 3A and 4A), water flow rates 304, 404 (FIGS. 3B and 4B), and gas flow rates 306, 406 (FIGS. 3C and 4C), the squares are the production predictions 308, 310, 312, 408, 410, 412 produced with this method, and the lines 314, 414 are the uncertainties (error bars) produced with this method. FIGS. 3A-3C show that a small degree of variation in flow rates from well tests results in a small difference between the actual flow rates and the inferred flow rates predicted by the disclosed method. FIGS. 4A-4C show that even when well tests provide less predictable production patterns and error bars are large, the inferred production predictions still provide good correlation to actual well test data.

It is important to note that the steps depicted in FIG. 2 are provided for illustrative purposes only and a particular step may not be required to perform the inventive methodology. The claims, and only the claims, define the inventive system and methodology.

The disclosed aspects have been described as being advantageously used to estimate and optimize real-time production; however, the disclosed aspects may also be used in historical analysis to estimate production on a well-by-well basis or a commingled well-basis.

Figure 5:
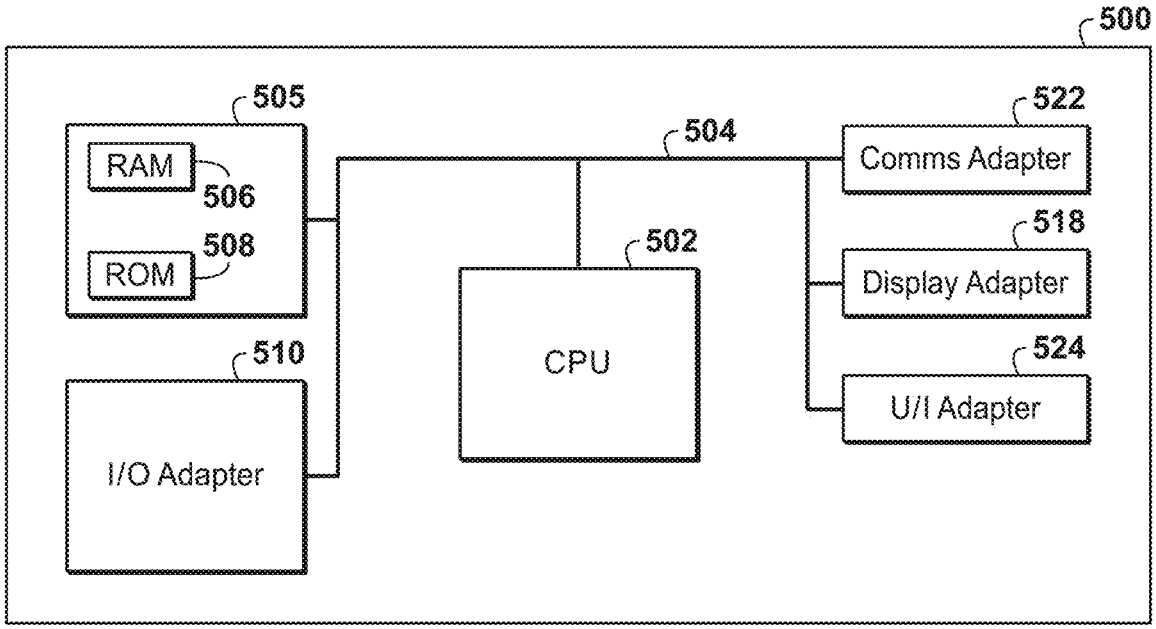
FIG. 5 is a schematic diagram of a computer system according to aspects of the disclosure.

FIG. 5 is a block diagram of a general purpose computer system 500 suitable for implementing one or more embodiments of the components described herein. The computer system 500 comprises a central processing unit (CPU) 502 coupled to a system bus 504. The CPU 502 may be any general-purpose CPU or other types of architectures of CPU 502 (or other components of exemplary system 500), as long as CPU 502 (and other components of system 500) supports the operations as described herein. Those of ordinary skill in the art will appreciate that, while only a single CPU 502 is shown in FIG. 7, additional CPUs may be present. Moreover, the computer system 500 may comprise a networked, multi-processor computer system that may include a hybrid parallel CPU/Graphics Processing Unit (GPU) system (not depicted). Alternatively, part or all of the computer system 500 may be included either in the firmware stored on sensors positioned to gather relevant pump and/or well test data, or in devices close to the well. The CPU 502 may execute the various logical instructions according to various embodiments. For example, the CPU 502 may execute machine-level instructions for performing processing according to the operational flow described above in conjunction with FIG. 2.

The computer system 500 may also include computer components such as non-transitory, computer-readable media or memory 505. The memory 505 may include a RAM 506, which may be SRAM, DRAM, SDRAM, or the like. The memory 505 may also include additional non-transitory, computer-readable media such as a Read-Only-Memory (ROM) 508, which may be PROM, EPROM, EEPROM, or the like. RAM 506 and ROM 508 may hold user data, system data, data store(s), process(es), and/or software, as known in the art. The memory 505 may suitably store measurements and/or well test data from one or more artificial lift wells for one or more time periods as described in connection with FIG. 2. The computer system 500 may also include an input/output (I/O) adapter 510, a communications adapter 522, a user interface adapter 524, and a display adapter 518.

The I/O adapter 510 may connect one or more additional non-transitory, computer-readable media such as an internal or external storage device(s) (not depicted), including, for example, a hard drive, a compact disc (CD) drive, a digital video disk (DVD) drive, a floppy disk drive, a tape drive, and the like to computer system 500. The storage device(s) may be used when the memory 505 is insufficient or otherwise unsuitable for the memory requirements associated with storing measurements and/or well test data for operations of embodiments of the present techniques. The data storage of the computer system 500 may be used for storing information and/or other data used or generated as disclosed herein. For example, storage device(s) may be used to store the decline models, measurement models, predictions of real-time production, associated measures of uncertainty, identified potential optimization opportunities, and instruction sets to automate part or all of the method disclosed in FIG. 2. Further, user interface adapter 524 may couple to one or more user input devices (not depicted), such as a keyboard, a pointing device and/or output devices, etc. to the computer system 500. The CPU 502 may drive the display adapter 518 to control the display on a display device (not depicted), e.g., a computer monitor or handheld display, to, for example, present potential optimization opportunities to a user.

The computer system 500 further includes a communications adapter 522. The communications adapter 522 may comprise one or more separate components suitably configured for computer communications, e.g., one or more transmitters, receivers, transceivers, or other devices for sending and/or receiving signals. The computer communications adapter 522 may be configured with suitable hardware and/or logic to send data, receive data, or otherwise communicate over a wired interface or a wireless interface, e.g., carry out conventional wired and/or wireless computer communication, radio communications, near field communications (NFC), optical communications, scan an RFID device, or otherwise transmit and/or receive data using any currently existing or later-developed technology.

The architecture of system 500 may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. Additional alternative computer architectures may be suitably employed, e.g., cloud computing, or utilizing one or more operably connected external components to supplement and/or replace an integrated component. Additional data gathering systems and/or computing devices may also be used. In fact, persons of ordinary skill in the art may use any number of suitable structures capable of executing logical operations according to the embodiments. In an embodiment, input data to the computer system 500 may include various plug-ins and library files. Input data may additionally include configuration information.

Figure 6:
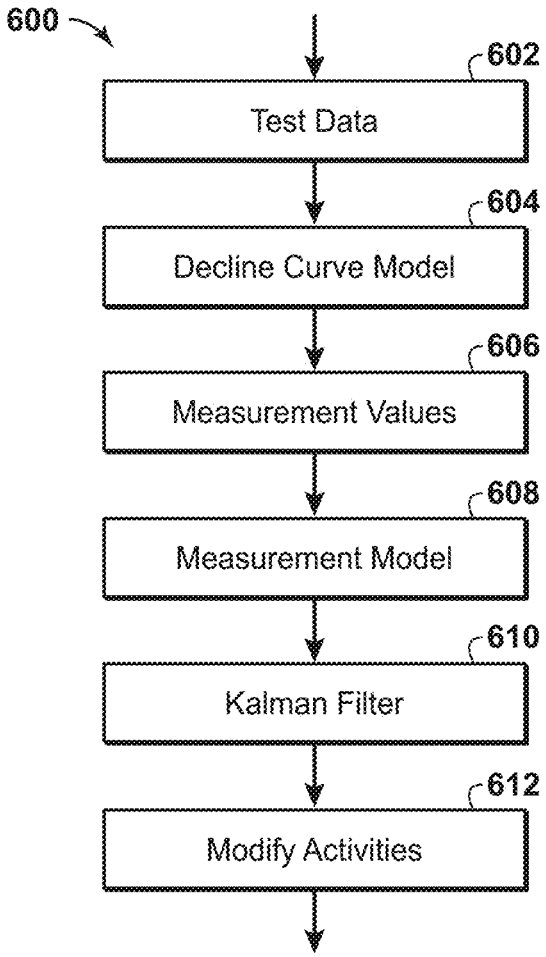
FIG. 6 is a flowchart of a method according to disclosed aspects.

FIG. 6 is a flowchart depicting a method 600 of predicting hydrocarbon production from one or more artificial lift wells, according to disclosed aspects. At block 602 test data is obtained from the artificial lift well using a well test. Based on the obtained test data, at block 604 a decline curve model is generated for one or more fluids in the artificial lift well. The decline curve represents well performance. At block 606 measurement values are obtained from an artificial lift operation. For example, the measurements may be obtained from a pump used in the artificial lift operation. These measurement values may include one or more of drive frequency of the motor associated with the pump, motor current of said motor, temperature of the motor, pump intake pressure, and pump intake temperature. For each of the obtained measurement values, at block 608 a measurement model is generated that correlates the measurement values to the decline curve. At block 610 a Kalman filter is used to: predict production outputs of at least one of oil, gas, and water for the well; and generate an uncertainty range for the predicted production outputs. As previously discussed, the Kalman filter uses the decline curves to predict the production outputs. Additionally, the Kalman filter uses the measurement models to correct and/or update the predicted production outputs. At block 612 hydrocarbon production activities are modified using the corrected and/or updated predicted production outputs.

An advantage of the disclosed methods is that it can still work even if measurement data from the pump is unavailable temporarily. Additionally, the impact of oil, water, and gas production can be determined and predicted separately. Additionally, because the data-driven models (decline curve, measurement model) are relatively simple, additional input measurements can be incorporated into the models easily if new data becomes available.

Disclosed aspects may be used in hydrocarbon management activities. As used herein, "hydrocarbon management" or "managing hydrocarbons" includes hydrocarbon extraction, hydrocarbon production, hydrocarbon exploration, identifying potential hydrocarbon resources, identifying well locations, determining well injection and/or extraction rates, identifying reservoir connectivity, acquiring, disposing of and/or abandoning hydrocarbon resources, reviewing prior hydrocarbon management decisions, and any other hydrocarbon-related acts or activities. The term "hydrocarbon management" is also used for the injection or storage of hydrocarbons or $CO_2$, for example the sequestration of $CO_2$, such as reservoir evaluation, development planning, and reservoir management. The disclosed methodologies and techniques may be used to produce hydrocarbons in a feed stream extracted from, for example, a subsurface region. Hydrocarbon extraction may be conducted to remove the feed stream from for example, the subsurface region, which may be accomplished by drilling a well using oil well drilling equipment. The equipment and techniques used to drill a well and/or extract the hydrocarbons are well known by those skilled in the relevant art. Other hydrocarbon extraction activities and, more generally, other hydrocarbon management activities, may be performed according to known principles.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described are considered to be within the scope of the disclosure.

The articles "the", "a" and "an" are not necessarily limited to mean only one, but rather are inclusive and open ended so as to include, optionally, multiple such elements.

It should be understood that numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method of predicting hydrocarbon production from an artificial lift well, comprising:

obtaining test data from the artificial lift well using a well test;

based on the obtained test data, generating a decline curve model for one or more fluids in the artificial lift well, the decline curve representing well performance;

obtaining measurement values from an artificial lift operation;

for each of the obtained measurement values, generating a measurement model that correlates the measurement values to the decline curve;

using a Kalman filter, predicting production outputs of at least one of oil, gas, and water for the well, and generating an uncertainty range for the predicted production outputs; wherein the Kalman filter uses the decline curves to predict the production outputs, and uses the measurement models to correct and/or update the predicted production outputs; and modifying hydrocarbon production activities using the corrected and/or updated predicted production outputs.

2. The method of claim 1, wherein correcting and/or updating the predicted production outputs comprises:

using the predicted production outputs to generate predicted current measurement values;

comparing the predicted current measurement values with real-time measurement values; and based on said comparing, correcting the predicted production outputs and corresponding uncertainty values.

3. The method of claim 1, wherein the decline curve comprises an increasing exponential decay model.

4. The method of claim 1, wherein the decline curve comprises a decreasing exponential decay model.

5. The method of claim 1, wherein modifying hydrocarbon production activities comprises modifying performance of one of the one or more artificial lift wells.

6. The method of claim 1, wherein modifying hydrocarbon production activities comprises one or more of modifying performance of a pump used in one of the one or more artificial lift wells, well stimulation activities, well intervention activities, and well work-over activities.

7. The method of claim 1, wherein the measurement values are obtained from a pump used in the artificial lift operation, the pump comprising an electric submersible pump or a progressing cavity pump.

8. The method of claim 7, wherein the measurement values include one or more of pump drive frequency, pump motor current, pump motor temperature, pump intake pressure, and pump intake temperature.

9. The method of claim 1, further comprising:

storing the well test data until the measurement model is generated.

10. The method of claim 1, wherein the obtained test data comprise one or more of oil production, water production, gas production, total liquid production, water cut, and gas/oil ratio.

11. An apparatus for predicting production data from one or more artificial lift wells, comprising:

a processor;

an input device in communication with the processor and configured to receive input data comprising measurement values from an artificial lift operation and well test data from the one or more artificial lift wells representing well performance at more than one time period;

a memory in communication with the processor, the memory having a set of instructions, wherein the set of instructions, when executed by the processor, are configured to:

generate a decline curve model based on the obtained test data for one or more fluids in the artificial lift well, the decline curve representing well performance;

for each of the measurement values, generate a measurement model that correlates the measurement values to the decline curve;

use a Kalman filter to predict production outputs of at least one of oil, gas, and water for the well, and generate an uncertainty range for the predicted production outputs;

wherein the Kalman filter uses the decline curves to predict the production outputs, and uses the measurement models to correct and/or update the predicted production outputs; and output corrected and/or updated predicted production outputs so that hydrocarbon production activities may be modified.

12. The apparatus of claim 11, wherein the set of instructions for correcting and/or updating the predicted production outputs comprises instructions to:

use the predicted production outputs to generate predicted current measurement values;

compare the predicted current measurement values with real-time measurement values; and based on said comparison, correct the predicted production outputs and corresponding uncertainty values.

13. The apparatus of claim 11, wherein the decline curve comprises an increasing exponential decay model.

14. The apparatus of claim 11, wherein the decline curve comprises a decreasing exponential decay model.

15. The apparatus of claim 11, wherein the modified hydrocarbon production activities comprises a modified performance of one of the one or more artificial lift wells.

16. The apparatus of claim 11, wherein the modified hydrocarbon production activities comprises one or more of a modified performance of a pump used in one of the one or more artificial lift wells, well stimulation activities, well intervention activities, and well work-over activities.

17. The method of claim 11, wherein the well test data is stored in the memory until the measurement model is generated.

18. The apparatus of claim 11, wherein the measurement values include one or more of pump drive frequency, pump motor current, pump motor temperature, pump intake pressure, and pump intake temperature.

19. The apparatus of claim 11, comprising a pump used in the artificial lift operation, wherein the pump is an electric submersible pump or a progressing cavity pump.

* * * * *